US012747665B2

(12) United States Patent
Wehrmeyer et al.

(10) Patent No.: US 12,747,665 B2
(45) Date of Patent: Sep. 29, 2026

(54) TUNNEL BORING MACHINE AND METHOD FOR TUNNELING USING A TUNNEL BORING MACHINE

(71) Applicant: HERRENKNECHT AKTIENGESELLSCHAFT, Schwanau (DE)

(72) Inventors: Gerhard Wehrmeyer, Schwanau (DE); Emil Nathanson, Friesenheim (DE); Johannes Tröndle, Lahr/Schwarzwald (DE)

(73) Assignee: HERRENKNECHT AKTIENGESELLSCHAFT, Schwanau (DE)

( * ) Notice: Subject to any disclaimer, the term of this patent is extended or adjusted under 35 U.S.C. 154(b) by 344 days.

(21) Appl. No.: 18/569,314

(22) PCT Filed: Sep. 22, 2022

(86) PCT No.: PCT/EP2022/076333
§ 371 (c)(1),
(2) Date: Dec. 13, 2023

(87) PCT Pub. No.: WO2023/057217
PCT Pub. Date: Apr. 13, 2023

(65) Prior Publication Data
US 2024/0295173 A1 Sep. 5, 2024

(30) Foreign Application Priority Data
Oct. 8, 2021 (DE) ..... 102021126200.3

(51) Int. Cl.
*E21D 9/00* (2006.01)
*E21D 9/10* (2006.01)
*E21D 9/11* (2006.01)

(52) U.S. Cl.
CPC ..... *E21D 9/003* (2013.01); *E21D 9/1093* (2013.01); *E21D 9/112* (2013.01)

(58) Field of Classification Search
CPC ..... E21D 9/003; E21D 9/1093; E21D 9/112
See application file for complete search history.

(56) References Cited

U.S. PATENT DOCUMENTS

| | | | |
|---|---|---|---|
| 9,951,617 | B2 | 4/2018 | Kuramoto |
| 11,566,522 | B2 | 1/2023 | Burger et al. |
| 2021/0032991 | A1* | 2/2021 | Burger ..... E21D 9/0873 |

FOREIGN PATENT DOCUMENTS

| | | | |
|---|---|---|---|
| CN | 111810171 | A | 10/2020 |
| CN | 111810172 | A | 10/2020 |

(Continued)

OTHER PUBLICATIONS

Anonymous "Bauma Innovation Award 2022 for Continuous Tunnelling—tunnel" Tunnel, vol. 06/22, Jun. 30, 2022 pp. 1-3 retrieved from the Internet: https://www.tunnel-online.info/en/artikel/bauma-innovation-award-2022-for-continuous-tunneling_3886 035.html [retrieved Jan. 6, 2023} XP093012084 the whole document.

*Primary Examiner* — Janine M Kreck
(74) *Attorney, Agent, or Firm* — Tucker Ellis LLP

(57) ABSTRACT

The invention relates to a tunnel boring machine (103) in which the thrust cylinders (109) acting on a cutting wheel (106) are controlled by means of the direct input of coordinate values of a desired total center of pressure (151) in a coordinate system (154, 157) relating to the tunnel boring machine (103).

12 Claims, 7 Drawing Sheets

(56) References Cited

FOREIGN PATENT DOCUMENTS

| | | | |
|---|---|---|---|
| JP | 2013007226 | A | 1/2013 |
| JP | 2019060131 | A | 4/2019 |

* cited by examiner

TUNNEL BORING MACHINE AND METHOD FOR TUNNELING USING A TUNNEL BORING MACHINE

RELATED APPLICATIONS

This application claims the benefit of International Application No. PCT/EP2022/076333, filed Sep. 22, 2022, and German Patent Appln. No. 102021126200.3, filed Oct. 8, 2021 the entirety of which are incorporated by reference herein.

TECHNICAL FIELD

The invention relates to a tunnel boring machine having a method for tunneling using a tunnel boring machine.

Such a device and such a method are known from DE 10 2018 102 330 A1. The previously known tunnel boring machine has a cutting wheel and a number of driving presses with which the cutting wheel can be moved in an advancing direction. Furthermore, there is a driving press control unit with which the driving presses can be controlled, wherein means for visualizing a total center of pressure resulting from the pressure effect of the driving presses are provided. When tunneling with this tunnel boring machine, the position of the total center of pressure can be visually displayed, particularly when installing segments, with corresponding load changes on the tunneling presses while the tunneling proceeds.

Tunnel boring machines and methods for tunneling are known from CN 111 810 171 A, CN 111 810 172 A and JP 2013 007 226 A, in which the pressure effect exerted by driving presses is based on group formations in the driving presses. According to CN 111 810 172 A, a visualization of the total force exerted is provided.

A tunnel boring machine is known from DE 11 2014 004 026 T5, which machine has input means which are configured to input geometric data for stroke control of the thrust rams in order thereby to influence the movement path of the tunnel boring machine. In particular, the means are set up to adjust the strokes of the thrust rams to maintain a movement path defined by geometry parameters, independently of the forces actually acting.

In practice, in tunnel boring machines, the driving forces to be exerted by individual driving presses or groups of driving presses are usually adjusted via potentiometers, which act on control modules connected to the driving presses.

SUMMARY

The object of the invention is to specify a tunnel boring machine of the type mentioned at the beginning and a method for tunneling with a tunnel boring machine of the type mentioned at the beginning, which are characterized by a relatively simple and reliable operation.

The fact that in the tunnel boring machine and in the method according to the invention, by specifying a desired total driving force, the actual position of an actual total center of pressure is directly influenced by influencing the position determined by coordinate values of a representation of a desired total center of pressure visualized in a coordinate system related to the tunnel boring machine and preferably via a touch-sensitive screen, the tunnel boring machine can be controlled relatively easily via this one central operating parameter. Further expedient embodiments and advantages of the invention result from the following description of exemplary embodiments with reference to the figures of the drawing, as well as to additional explanations.

In the figures:

DETAILED DESCRIPTION

Figure 1:
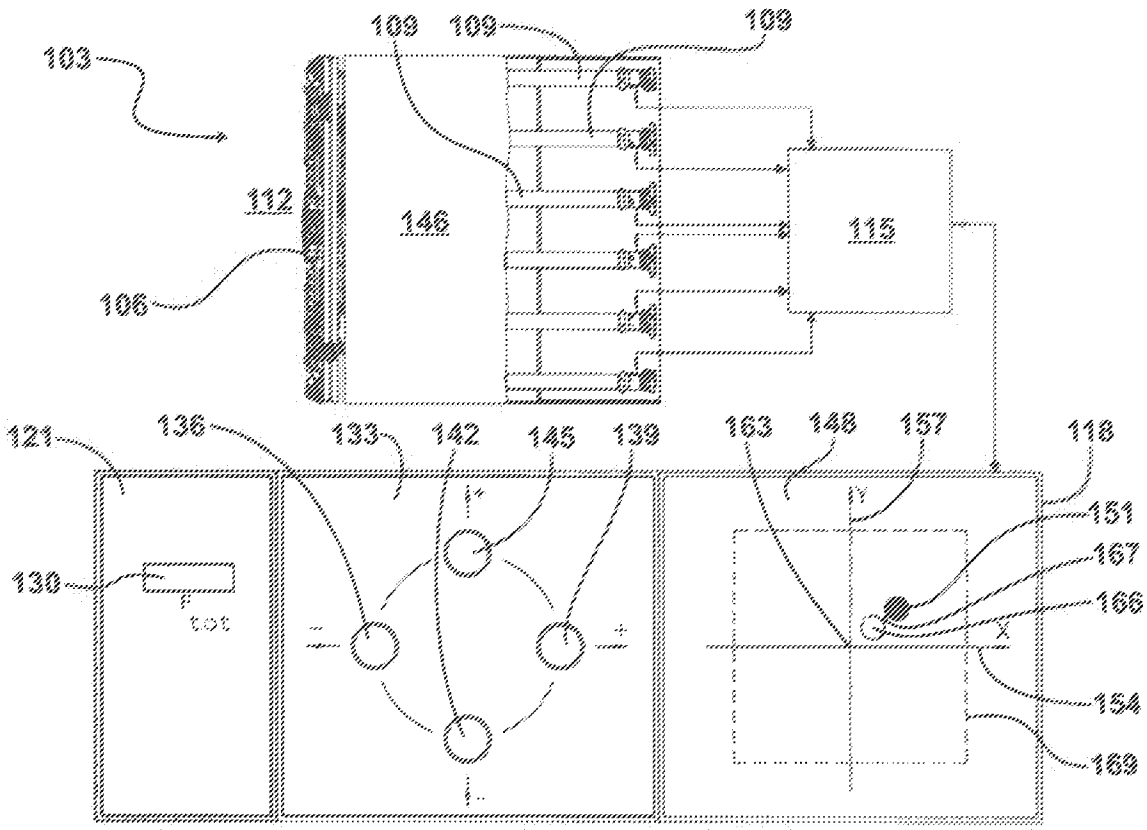
FIG. 1 is a schematic view of an exemplary embodiment of a tunnel boring machine having a cutting wheel and provided with an operating unit.

FIG. 1 shows a schematic view of an exemplary embodiment of a tunnel boring machine 103 according to the invention, which is equipped with a cutting wheel 106 located at the front in the mining direction. In the mining direction, at the back of the cutting wheel 106, the tunnel boring machine 103 has a number of thrust cylinders 109, with which the cutting wheel 106 can be displaced in an advancing direction and can be pressed against a tunnel face 112 lying in front of the cutting wheel 106 in the mining direction during mining operation.

The thrust cylinders 109 are uniformly connected individually or combined in groups to a driving press control unit 115, with which the thrust cylinders 109 can be controlled to achieve a pressure effect.

The driving press control unit 115 in turn is connected to an operating unit 118, via which the control values required for driving the thrust cylinders 109 can be fed to the driving press control unit 115 after converting coordinate values explained in more detail below into control values corresponding to pressure values.

The operating unit 118 has, on the one hand, a touch-sensitive screen with a first input region 121, via which a machine operator can directly input a set value, in an input field 130 as an input means, for the desired total driving force $F_{tot}$ to be exerted by the thrust cylinders 109 or the groups of thrust cylinders 109 on the cutting wheel 106.

In modifications for the direct input of the desired total driving force $F_{tot}$, for example, touch-sensitive regions or electromechanical buttons or elements that act electromechanically by turning or moving, such as potentiometers or sliders, are provided in the first input region 121.

In a further embodiment, not shown, a driving speed control circuit is present as an input means for specifying a desired total driving force $F_{tot}$, to which a desired driving speed can be fed in by a machine operator in a first input and the currently prevailing actual driving speed of the tunnel boring machine 103 can be fed in a second input. The output of the driving speed control loop supplies the desired total driving force $F_{tot}$ as a set point for further processing, explained in more detail below, to maintain the desired driving speed.

In addition, the operating unit 118 is provided with a second input field 133, which is formed with a number of, in particular, four, buttons 136, 139, 142, 145 as operating elements, which in the example described here are formed by a paired arrangement on a horizontal or a vertical to reduce or increase coordinate values of a desired total center of pressure (also called "Center of Thrust", abbreviated to "CoT") in a coordinate system related to the tunnel boring machine 103, and in particular to the longitudinal center axis of a substantially cylindrical shield element 146 of the tunnel boring machine 103, in which the thrust cylinders 109 are arranged and fixed, which results from the pressure effect of all thrust cylinders 109.

In an embodiment, the touch panels 136, 139, 142, 145 are designed to be touch-sensitive parts of the touch-sensitive screen.

In another embodiment, the touch panels 136, 139, 142, 145 are designed to be pressure-sensitive as electromechanical buttons.

In a still further embodiment, the means for influencing the desired total center of pressure have elements such as potentiometers or sliders that act electromechanically by rotating or displacing.

Furthermore, the screen of the operating unit 118 in this exemplary embodiment has a further, two-dimensional touch-sensitive region 148 as a visualization means, on which a symbolic visualization of a desired total center of pressure 151 is represented by a coordinate system, which is spanned by an X-axis 154 for the horizontal direction and by an Y-axis 157 for the vertical direction, which axes intersect at right angles in a zero point 163, as the coordinate origin, and which system is related to the tunnel boring machine 103.

The visualization shown in FIG. 1 with a black filled circle is the desired total center of pressure 151, the coordinate values of which form in the coordinate system formed by the X-axis 154 and the Y-axis 157 together with the value for the desired total driving force $F_{tot}$ to be exerted, which can be entered, for example, via the input field 130, the input values for the driving press control unit 115 for controlling the thrust cylinders 109.

In an expedient further development, it is provided that an actual total center of pressure 166 is also shown on the touch-sensitive region 148 in a further visualization, shown as a white filled circle, which actually represents the current actual position of the actual total center of pressure 166 returned by the driving press control unit 115 from the thrust cylinders 109 to the operating unit 118. In the illustration according to FIG. 1, the actual total center of pressure 166 deviates still considerably from the desired total center of pressure 151, for example due to a still incomplete control, explained further below, and will move during control, further in the direction of a control direction arrow 167, which in the representation of FIG. 1, extends from the actual total center of pressure 166 to the desired total center of pressure 151.

To change the position of the actual total center of pressure 166, in addition to the touch fields 136, 139, 142, 145, the desired total center of pressure 151 in the touch-sensitive region 148 can be changed in two dimensions by touching and moving the visualization of the desired total center of pressure 151, for example with a finger of an operator or with an interactive pen with a corresponding change in the control values fed to the driving press control unit 115 with associated pressure value changes, insofar as this is permitted in principle by the operating conditions of the tunnel boring machine 103 within a permissible value range 169 shown, purely for illustrative purposes, in dashed lines in the illustration according to FIG. 1, for achieving a new actual total center of pressure 166.

Figure 2:
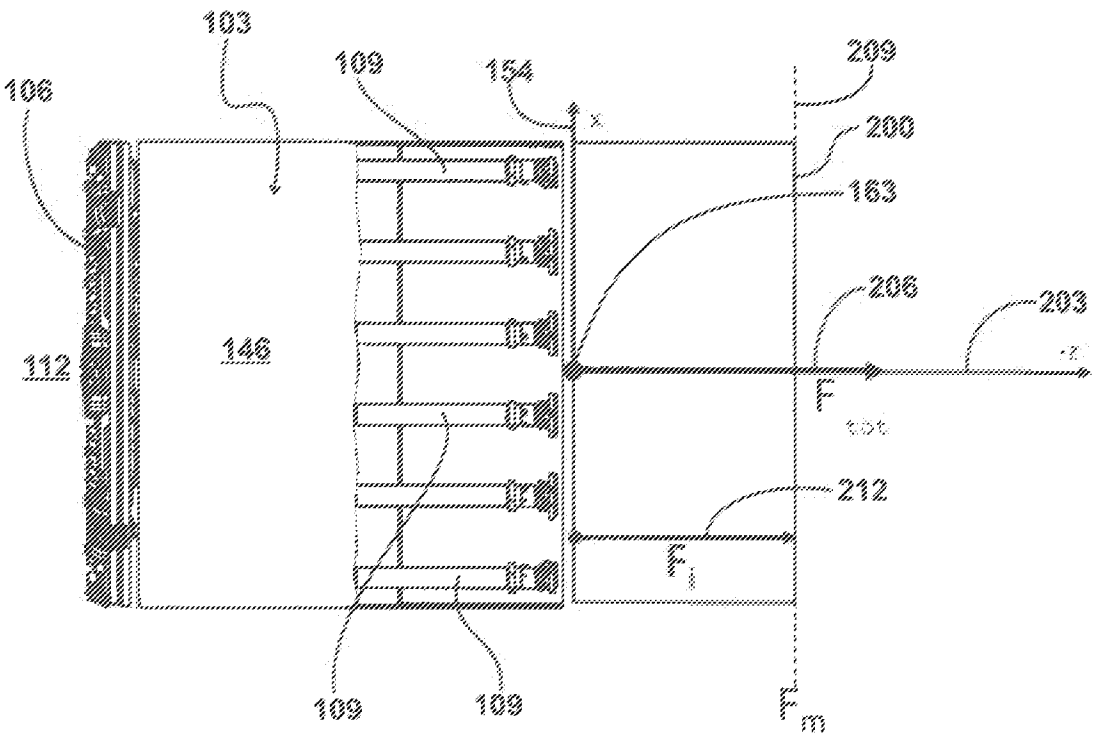
FIG. 2 is a side view of the exemplary embodiment of a tunnel boring machine according to FIG. 1, with an exemplary force profile exerted by driving presses in a horizontal (X) direction, which is constant over the entire diameter of the cutting wheel, for straight travel.

FIG. 2 is a side view of the exemplary embodiment of a tunnel boring machine 103 according to FIG. 1, with an exemplary force profile 200 exerted by thrust cylinders 109 in a horizontal direction along the X-axis 154, which is constant over the entire diameter of the cutting wheel 106, for straight travel. In the illustration according to FIG. 2, the Z-axis 203, which is shown in FIG. 2 with its negative value range, in the coordinate system related to the tunnel boring machine 103, the direction of the longitudinal center axis of the shield element 146, which is the reference for the coordinate system in this example and advantageously in other cases too.

Furthermore, in FIG. 2 there is a total force vector arrow 206 for the desired total driving force $F_{tot}$ to be exerted by the entirety of the thrust cylinders 109, which can be entered via the input field 130, and represents a value for the average force $F_m$ shown by a dashed line 209.

In the exemplary embodiment shown in FIG. 2, for straight travel, with respect to a horizontal, in the sense of curve-free driving along a straight line lying in this horizontal, each thrust cylinder 109 or each group of thrust cylinders 109 exerts the same partial driving force FR corresponding to the average force $F_m$ and represented by one partial force vector arrow 212, so that the force profile 200 lying on line 209 is constant over the diameter of the cutting wheel **10*e* and the desired total driving force $F_{tot}$ lies exactly on the Z-axis 203 and passes through the zero point 103 of the X-axis 154. As a result, an offset of the desired total driving force $F_{tot}$ from the Z axis 203 in the X direction and thus an X offset $CoT_X$ as the coordinate value of the desired total center of pressure 151 from the Z axis 203** in the X direction is zero.

Figure 3:
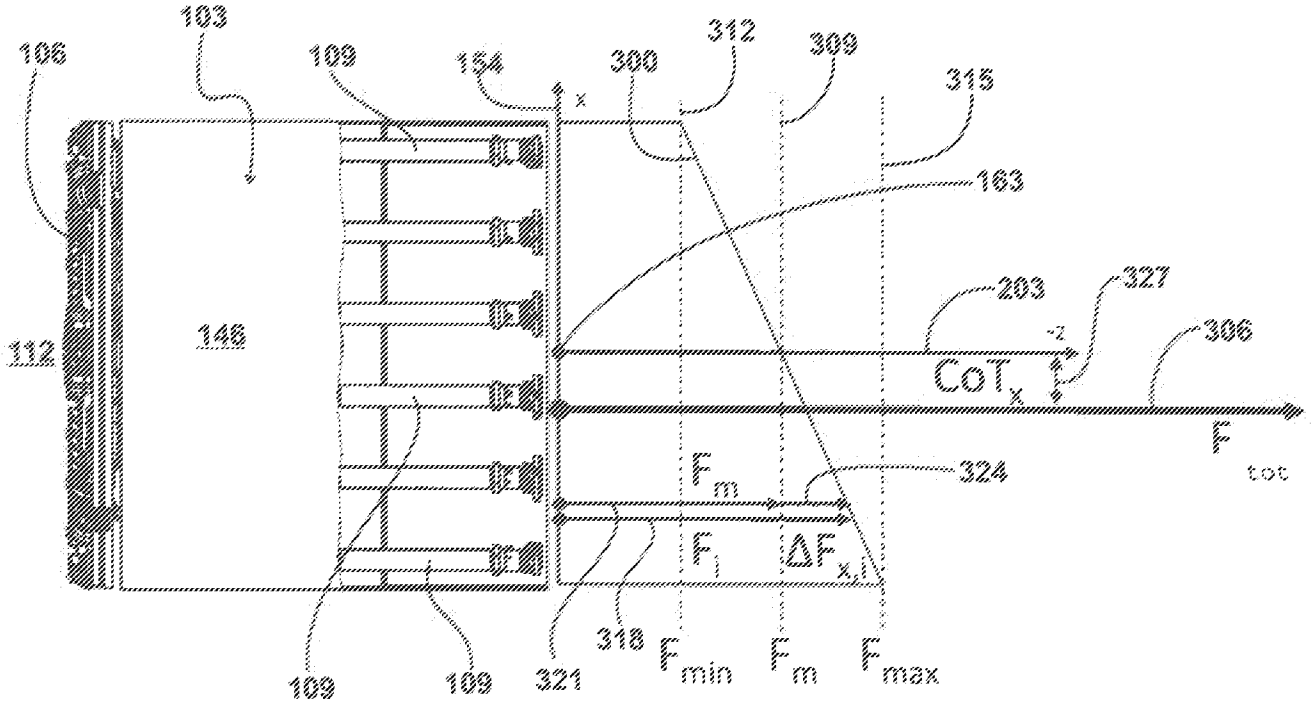
FIG. 3 is a side view of the exemplary embodiment of a tunnel boring machine according to FIG. 1 with an exemplary force profile exerted by driving presses in a horizontal (X) direction, which is constantly changing over the entire diameter of the cutting wheel, for curve travel.

FIG. 3 is a side view corresponding to FIG. 2, of the exemplary embodiment of a tunnel boring machine 103 according to FIG. 1, with an exemplary force profile 300 exerted by thrust cylinders 109 in a horizontal direction along the X-axis 154, which is constantly changing over the entire diameter of the cutting wheel 106, for curve travel.

In FIG. 3 a total force vector arrow 306 for the desired total driving force $F_{tot}$ to be exerted by the entirety of the thrust cylinders 109, which can be entered via the input field 130, is shown, in which a first dashed line 309 shows a value for the average force $F_m$ to be exerted, a dashed second line 312 shows a value for the minimum force $F_{min}$ to be exerted and a dashed third line 315 shows a value for the maximum force $F_{max}$ to be exerted.

Furthermore, in FIG. 3, a partial force vector arrow 318 represents, for example the partial driving force $F_i$ to be exerted by a thrust cylinder 109 or a group of thrust cylinders 109, in this case a thrust cylinder 109 positioned horizontally on a side and relatively on the edge, and an average force vector arrow 321 represents the average force $F_m$ to be exerted by the entirety of the thrust cylinders 109. With a differential force vector arrow 324, the differential force $\Delta F_{x,i}$ is shown as the difference in the X direction from the partial driving force $F_i$ and the average force $F_m$. Finally, a double arrow 327 shows the offset of the desired total driving force $F_{tot}$ from the Z axis in the X direction and thus as a coordinate value the X offset $CoT_X$ of the desired total center of pressure 151 from the Z-axis 203 in the X direction, which is included in the visualization of the respective total center of pressure 151, 166 in the coordinate system reproduced in the region 148.

To accomplish curved travel, the force profile 300 is configured in the X direction between the minimum force $F_{min}$ and the maximum force $F_{max}$ with a force which continuously changes over the entire diameter of the cutting wheel 106, by successive increase of the force exerted by the thrust cylinders 109 or groups of thrust cylinders 109, starting with the minimum force $F_{min}$ with differential forces $\Delta F_{x,i}$ of initially negative and then positive values up to the Z axis 203 up to the maximum force $F_{max}$.

Figure 4:
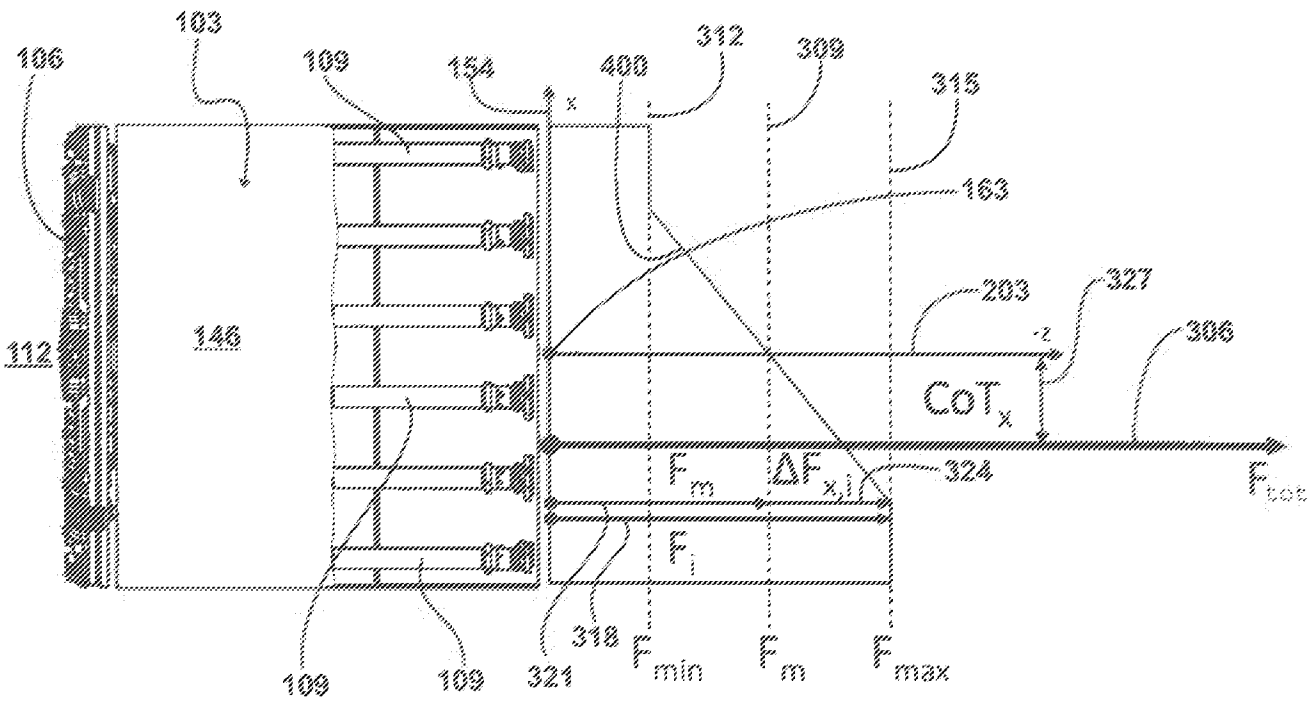
FIG. 4 is a side view of the exemplary embodiment of a tunnel boring machine according to FIG. 1 with an exemplary force profile exerted by driving presses in a horizontal (X) direction, which is continuously changing over part of the diameter of the cutting wheel, for curve travel.

FIG. 4 shows, in a side view corresponding to FIGS. 2 and 3, the exemplary embodiment of a tunnel boring machine 103 according to FIG. 1 with force profile 400, for curve travel, exerted by thrust cylinders 109 in the horizontal direction along the X axis 154, continuously changing over part of the diameter of the cutting wheel 106, wherein, in order to avoid repetitions, the reference numerals used in FIGS. 3 and 4 indicate corresponding previous elements.

From FIG. 4 it can be seen that the partial driving forces $F_i$ exerted by the thrust cylinders 109 or groups of thrust cylinders 109 are the same over a certain edge region and correspond to the minimum force $F_{min}$ or the maximum force $F_i$ while between these edge regions over a central region Partial driving forces F change continuously, which also leads to an X-position $CoT_X$ of the total center of pressure from the Z-axis 203 in the X direction and thus to a horizontal curve travel.

Figure 5:
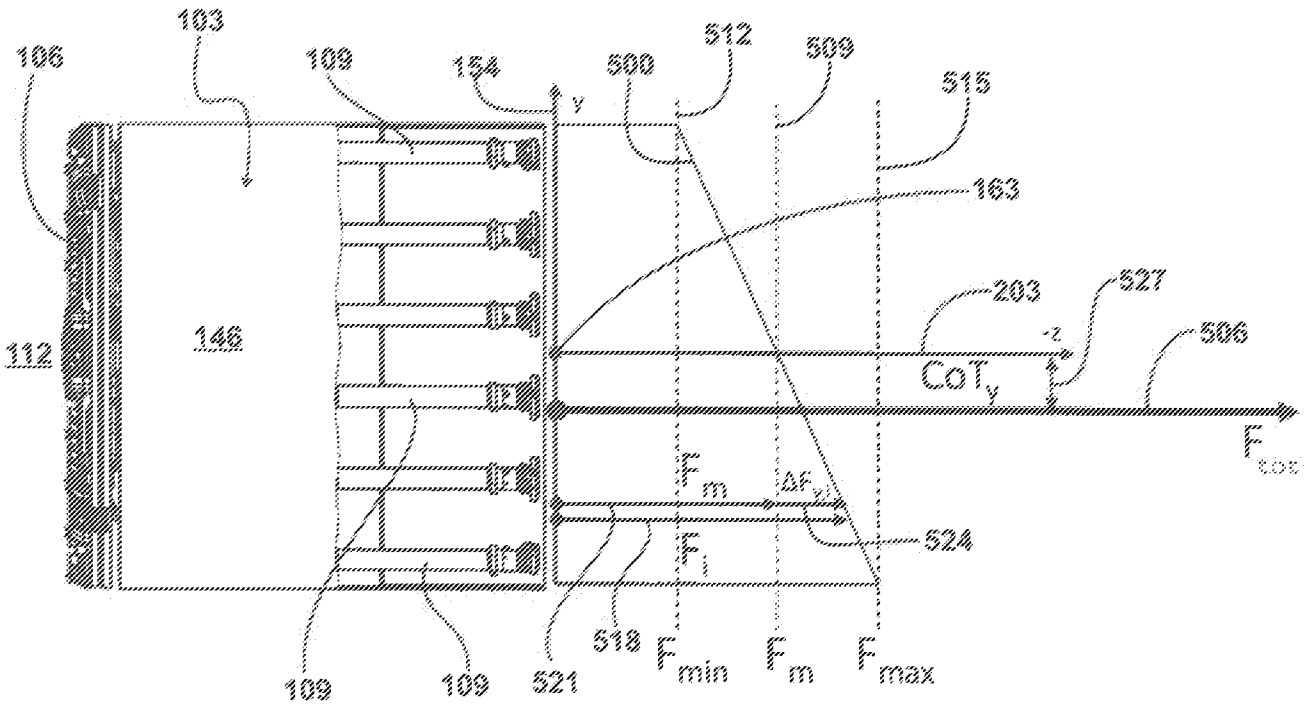
FIG. 5 is a side view of the exemplary embodiment of a tunnel boring machine according to FIG. 1, with an exemplary force profile exerted by driving presses in a vertical (Y) direction, which is constantly changing over the entire diameter of the cutting wheel, for compensating counterforces which change along the vertical, for horizontal travel.

FIG. 5 shows, in a side view rotated by 90 degrees compared to the side views according to FIGS. 2 to 4, the exemplary embodiment of a tunnel boring machine 103 according to FIG. 1 with an exemplary force profile 500 exerted by thrust cylinders 109 in the vertical direction along the Y axis 157, which constantly changes over the entire diameter of the cutting wheel 106, to compensate for counterforces that change in opposite directions in the vertical, such as earth pressure, water pressure, friction and the like, for horizontal travel.

In FIG. 5 a total force vector arrow 506 for the desired total driving force $F_{tot}$ to be exerted by the entirety of the thrust cylinders 109, which can be entered via the input field 130, is shown, in which a first dashed line 509 shows a value for the average force $F_m$ to be exerted, a dashed second line 512 shows a value for the minimum force $F_{min}$ to be exerted and a dashed third line 515 shows a value for the maximum force $F_{max}$ to be exerted.

Furthermore, in FIG. 5, a partial force vector arrow 518 represents, for example the partial driving force $F_i$ to be exerted by a thrust cylinder 109 or a group of thrust cylinders 109, in this case a thrust cylinder 109 positioned vertically and relatively near to the tunnel sole, and an average force vector arrow 521 represents the average force $F_m$ to be exerted by the entirety of the thrust cylinders 109. With a differential force vector arrow 524, the differential force $\Delta F_{y,i}$ is shown as the difference in the Y direction from the partial driving force $F_i$ and the average force $F_m$. Finally, a double arrow 527 shows the offset of the desired total driving force $F_{tot}$ from the Z axis in the Y direction and thus as a coordinate value the Y offset $CoT_Y$ of the desired total center of pressure 151 from the Z-axis in the Y direction, which is included in the visualization of the respective total center of pressure 151, 166 in the coordinate system reproduced in the region 148.

In the force profile 500 shown in FIG. 5, the thrust cylinders 109 compensate for the counterforces usually uniformly increasing with depth, on the tunnel face 112, in order to perform a horizontal travel, namely a tunneling in a horizontal without deviations in the vertical direction.

Figure 6:
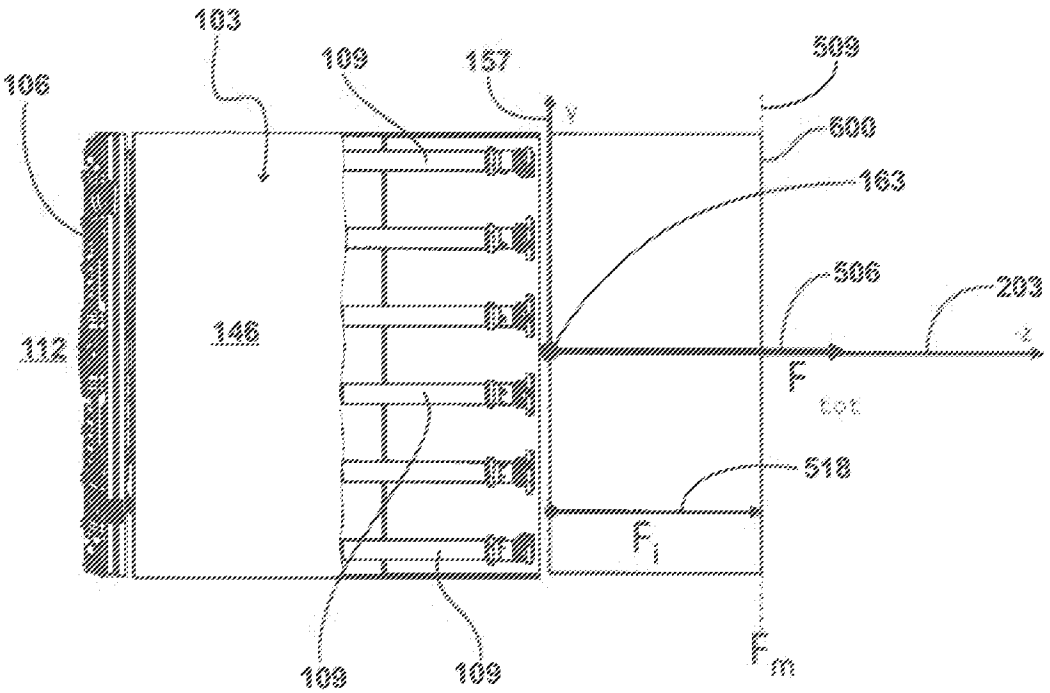
FIG. 6 is a side view of the exemplary embodiment of a tunnel boring machine according to FIG. 1 with an exemplary force profile exerted by driving presses in a vertical (Y) direction, which is constant over the entire diameter of the cutting wheel, for downwards diving travel.

FIG. 6 shows, in a side view according to FIG. 5, the exemplary embodiment of a tunnel boring machine 103 according to FIG. 1 with an exemplary force profile 600 exerted by thrust cylinders 109 in the vertical direction along the Y axis 157, which is constant over the entire diameter of the cutting wheel 106, for performing a downward emerging travel during tunneling, wherein, in order to avoid repetitions, the same reference numbers used in FIGS. 5 and 6 designate corresponding elements.

From FIG. 6 it can be seen that with this force profile 600, which remains constant in the vertical along the Y-axis 157, with partial driving forces $F_i$ corresponding to the average force $F_m$ and thus a disappearance of the Y-position $CoT_Y$ of the desired total center of pressure 151 from the Z-Axis 203 in the Y direction, the desired total driving force $F_{tot}$ lies on the Z axis 203 and the Y axis 157 intersects at the zero point 163 of the coordinate system. As a result, the counterforces on the face 112 are overcompensated in the upper region near the ridge and undercompensated in the region of the tunnel floor, so that the trajectory of tunneling tilts downwards and the tunneling machine 103 is submerged compared to horizontal travel.

Figure 7:
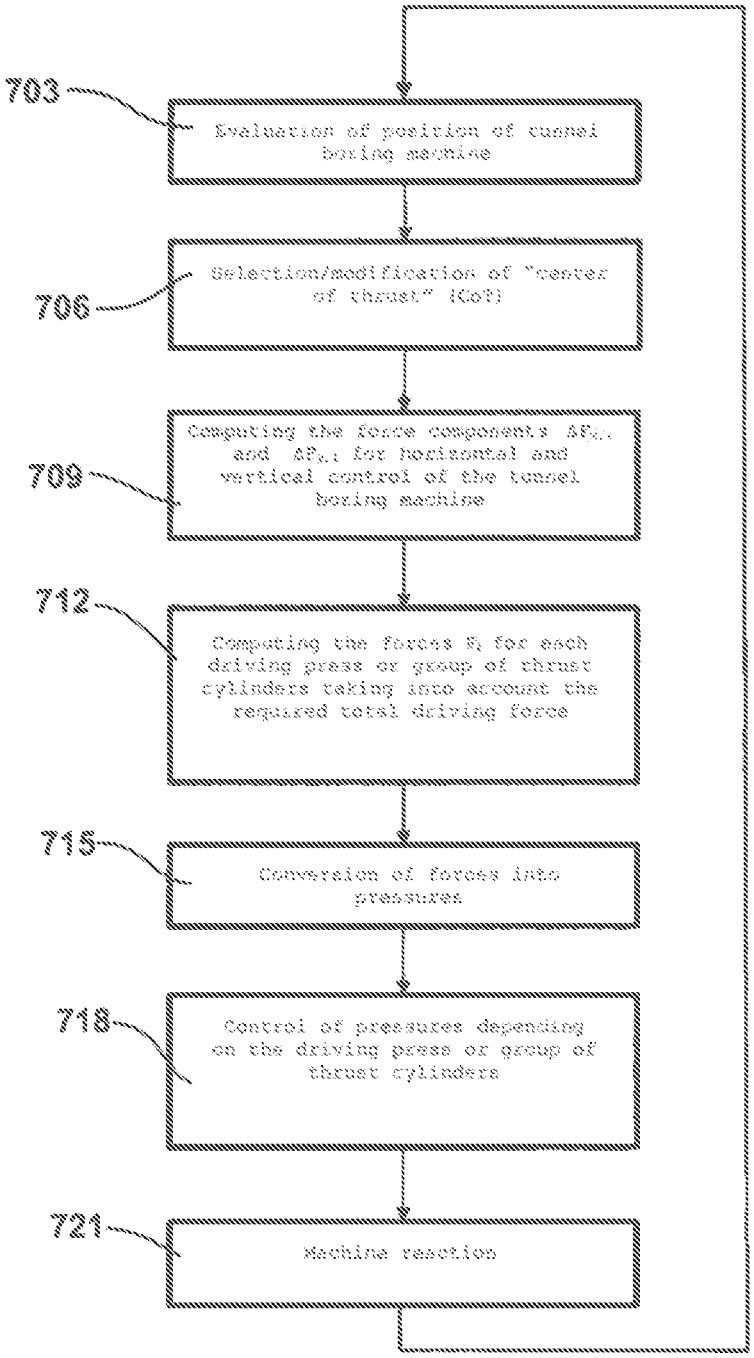
FIG. 7 is a flow chart of an exemplary embodiment of the procedure for operating a tunnel boring machine for tunneling with the exemplary embodiment of a tunnel boring machine according to the invention explained with reference to FIGS. 1 to 3.

FIG. 7 shows a flowchart of the basic procedure for a method for tunneling with a tunnel boring machine 103 according to the invention. In an evaluation step 703, the current position of the tunnel boring machine 103 is evaluated, taking into account the other operating parameters of the tunnel boring machine 103.

In an adjustment step 706 following the evaluation step 703, a selection is initially made or, if necessary, a change of the total center of pressure 151, also called "center of thrust", abbreviated "CoT", during the advance, in that its coordinates in the coordinate system are set either by the key fields 136, 139, 142, 145 or by moving its visualization in the touch-sensitive region 148.

In accordance with the embodiment explained with reference to FIG. 1, the desired total driving force $F_{tot}$ is directly specified via the input field 130 as an input means.

In the further embodiment, not shown, with the driving speed control circuit as an input means, the driving speed control circuit specifies the desired total driving force $F_{tot}$ to maintain a desired driving speed.

In a first calculation step 709 following the setting step 706 and carried out by means of the driving press control unit 115, the force components of the forces $F_i$ for the horizontal or vertical control of the tunnel boring machine 103 to be exerted are calculated by specifying the values $CoT_X$, $CoT_Y$ and $F_{tot}$ explained above through their variable components $\Delta F_{x,i}$ and $\Delta F_{y,i}$.

In a second calculation step 712 following the first calculation step 709, the forces $F_i$ to be exerted by each i-th thrust cylinder 109 or each i-th group of thrust cylinders 109 are also calculated using the driving press control unit 115 to generate the desired respective force components $\Delta F_{x,i}$, $\Delta F_{y,i}$ taking into account the desired total driving force $F_{tot}$ to be exerted. In a conversion step 715 following the second calculation step 712, the forces $F_i$ to be exerted by the thrust cylinders 109 are converted into the hydraulic pressures with which the respective thrust cylinders 109 are to be operated in order to actually exert the forces $F_i$.

In a control step 718 following the conversion step 715, the hydraulic pressures actually acting on the thrust cylinders 109 are regulated in order to bring the actual total center of pressure 166 closer to the desired total center of pressure 151 and ultimately bring the two essentially into overlap.

In an operating step 721 following the control step 718, the tunnel boring machine 103 is operated according to the last used operating data for a predetermined time unit, which can be freely selected to a certain extent, until the next evaluation step 703 is carried out.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

The invention claimed is:

1. A tunnel boring machine with a cutting wheel (106), comprising:

a number of driving presses (109) with which the cutting wheel (106) can be moved in a driving direction, a driving press control unit (115) with which the driving presses (109) or groups of driving presses (109) can be controlled, visualization means (148) which are configured to visualize an actual total center of pressure (166) resulting from the pressure effect of the driving presses (109) or groups of driving presses (109), input means (130) configured to specify a desired total driving force ($F_{tot}$), in that the visualization means (148) are configured to display a desired total center of pressure (151) and the actual total center of pressure (166), and an operating unit (118) connected with the driving press control unit (115) for influencing the actual total center of pressure (166) by changing coordinate values ($CoT_x$, $CoT_Y$) of the desired total center of pressure (151) in a coordinate system (154, 157) related to the tunnel boring machine (103) for at least approximating the actual total center of pressure (166) to the desired total center of pressure (151), and in that the driving press control unit (115) is configured to convert the change of coordinate values ($CoT_x$, $CoT_Y$) of the desired total center of pressure (151) into pressure value changes when controlling the driving presses (109) or groups of driving presses (109) and adjust them accordingly.

2. The tunnel boring machine according to claim 1, wherein the operating unit includes operating elements (136, 139, 142, 145) for directly entering coordinate values and/or for increasing or decreasing coordinate values ($CoT_x$, $CoT_Y$) for influencing the desired total center of pressure (151).

3. The tunnel boring machine according to claim 2, wherein for increasing or decreasing coordinate values ($CoT_x$, $CoT_Y$) of the desired total center of pressure (151), the operating unit has a portion (133) with pressure-sensitive touch fields.

4. The tunnel boring machine according to claim 2, wherein for increasing or decreasing coordinate values ($CoT_x$, $CoT_Y$) of the desired total center of pressure (151), the operating unit includes a portion (133) with pressure-sensitive electromechanical buttons.

5. The tunnel boring machine according to claim 4, wherein the coordinate values ($CoT_x$, $CoT_Y$) of the desired total center of pressure (151) are increased or decreased by at least one of rotating or moving the electromechanical buttons.

6. The tunnel boring machine according to claim 1, wherein a screen with a touch-sensitive region (148) is present in which the visualized desired total center of pressure (151) when touched by and moved by a finger or object, can be moved from an initial position into an end position, wherein the deviations in the coordinate values ($CoT_x$, $CoT_Y$) of the end position relative to the initial position form the input values of the driving press control unit (115) for adapting the pressure forces exerted by the driving presses (109) or groups of driving presses (109).

7. The tunnel boring machine according to claim 1, wherein the coordinate system is a two-axis orthogonal coordinate system (154, 157) with the zero point (163) on the longitudinal central axis of a shield element (146) of the tunnel boring machine (103), in which the driving presses (109) or groups of driving presses (109) are arranged.

8. The tunnel boring machine according to claim 1, wherein the visualization means (148) are configured to display a permissible value range (169) for the desired total center of pressure (151), and in that the driving press control unit (115) is configured to process only values for a desired total center of pressure (151) that lie within the permissible value range (169).

9. The tunnel boring machine according to claim 1, wherein a driving speed control circuit is present as an input means, which is configured to set the desired total driving force ($F_{tot}$) via a desired driving speed that can be fed into a first input and via an actual driving speed that can be fed into a second input while maintaining the desired driving speed.

10. The tunnel boring machine according to claim 1, wherein the operating unit includes means (133, 136, 139, 142, 145, 148) for influencing the actual total center of pressure.

11. A method for tunneling with a tunnel boring machine (103), comprising the steps providing a tunnel boring machine (103) according to claim 1, setting a desired trajectory, determining initial driving forces of the driving presses (109) or groups of driving presses (109), and during the advance, repeatedly adjusting of the driving forces by changing a desired total center of pressure (151) in coordinate values ($CoT_x$, $CoT_Y$) of the desired total center of pressure (151) of the coordinate system (154, 157) relating to the tunnel boring machine (103).

12. A tunnel boring machine with a cutting wheel, comprising:

driving presses for moving the cutting wheel in a driving direction;

a driving press control unit for controlling the driving presses;

input means configured to specify a desired total driving force;

a screen for visualizing an actual total center of pressure resulting from the pressure effect of the driving presses and to display the desired total center of pressure; and an operating unit connected with the driving press control unit for influencing the actual total center of pressure by changing coordinate values of the desired total center of pressure in a coordinate system related to the tunnel boring machine for at least approximating the actual total center of pressure to the desired total center of pressure, wherein the driving press control unit is configured to convert the change of coordinate values of the desired total center of pressure into pressure value changes when controlling the driving presses and adjust them accordingly.

* * * * *